United States Patent [19]

Wang

[11] 4,415,201

[45] Nov. 15, 1983

[54] FOLDING CHAIR HAVING A REVERSIBLE SEAT

[76] Inventor: Teng-Ching Wang, Room 600, Chung An Bldg., 16, Ming Sheng W. Rd.3, Taipei, Taiwan

[21] Appl. No.: 258,294

[22] Filed: Apr. 28, 1981

[51] Int. Cl.[3] ..... A47C 27/00; A47C 4/00

[52] U.S. Cl. ..... 297/57; 297/92; 297/94; 297/283

[58] Field of Search ..... 297/57, 58, 92, 94, 297/283, 16, 118, 218, 353, 354

[56] References Cited

U.S. PATENT DOCUMENTS

| | | | |
|---|---|---|---|
| 105,253 | 7/1870 | Rodgers | 297/57 |
| 306,158 | 10/1882 | Johnson | 297/283 |
| 672,980 | 4/1901 | Hunter | 297/283 |
| 1,005,330 | 10/1911 | Schmits et al. | 297/283 |
| 2,272,307 | 2/1942 | Merril | 297/57 |

FOREIGN PATENT DOCUMENTS

| | | | |
|---|---|---|---|
| 163241 | 8/1933 | Switzerland | 297/92 |
| 10623 | 9/1910 | United Kingdom | 297/284 |

*Primary Examiner*—James T. McCall

*Attorney, Agent, or Firm*—Cushman, Darby & Cushman

[57] ABSTRACT

A folding chair having a reversible seat wherein the two faces of the seat are preferably made of different materials. At the inner side of each long leg of the chair there is a a sliding groove to facilitate up and down sliding movement of the chair seat during the process of changing the chair seat and the chair back. A leaf spring is provided in the chair back for adjusting it an appropriate angle to fit the user wherein the chair back is automatically restored to its original position upon removal of pressure thereon.

30 Claims, 8 Drawing Figures

FOLDING CHAIR HAVING A REVERSIBLE SEAT

THE BACKGROUND OF THE INVENTION

All conventional folding chairs are of one-direction folding and unfolding type having only one seat surface which can be made of rattan, wood, foam rubber, or sponge, etc. Since the two former materials exhibit better ventilation qualities, they are preferred for making chair seats for summer time use. Since the latter two materials exhibit warming qualities, they are preferred for making chair seats for winter time use. Once a conventional folding chair is manufactured, its use is fixed for either summer time use or winter time use. In other words, its use is limited and is unable to meet the requirements in an area having different seasonal modes.

BRIEF SUMMARY OF THE INVENTION

In view of the facts mentioned above, the inventor has developed the present invention, a folding chair having a seat made of two different materials. The chair seat and back are reversible to expose the material desired by the user by folding the chair seat along a sliding groove defined along the inner side of the two long legs of the chair. Further, on the chair back, a leaf spring is provided so as to adjust the chair back at an appropriate and comfortable angle for user, the chair back being restored to its original position automatically upon pressure thereagainst being removed. The main object of this invention is to provide a folding chair with a reversible seat having two chair seat surfaces made of different materials so as to meet the requirements of both summer time and winter time use. A further object of this invention is to provide a folding chair which can be folded up into a flat and small form to facilitate handling and storage.

A still further object of this invention is to provide a folding chair wherein the chair back can be automatically adjusted at an appropriate and comfortable angle for the user.

BRIEF DESCRIPTION OF THE DRAWINGS

Reference will be hereinafter made to the drawings wherein.

DETAILED DESCRIPTION OF THE PREFERRED EMBODIMENTS

Figure 1:
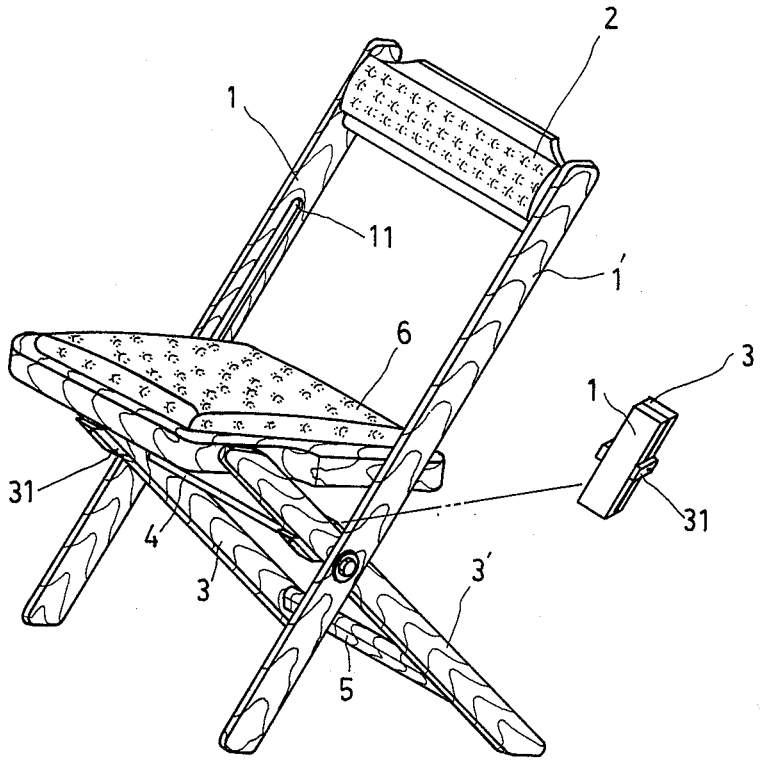
FIG. 1 is a perspective view of the present invention.
Figure 2A:
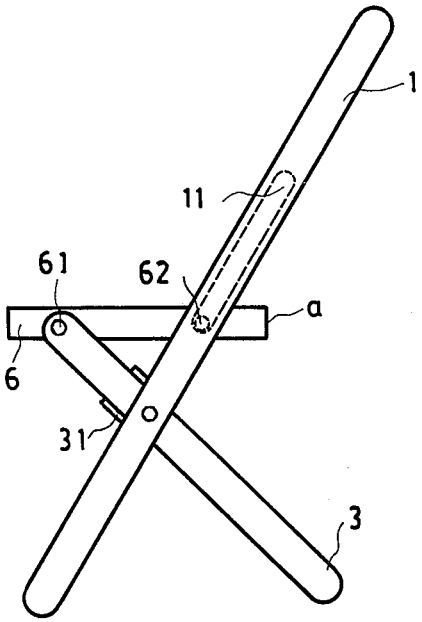
FIGS. 2—*2d* shows the gradual steps utilized to reverse the chair seat and back.
Figure 2B:
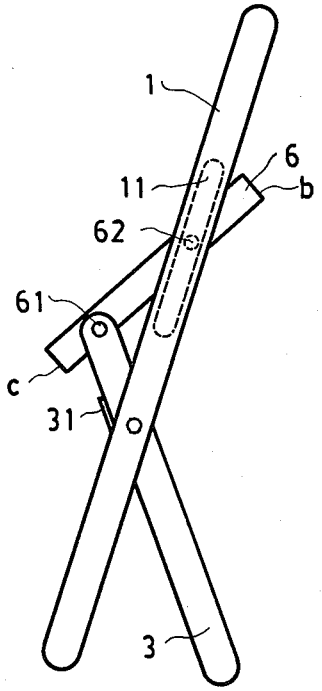
Figure 2C:
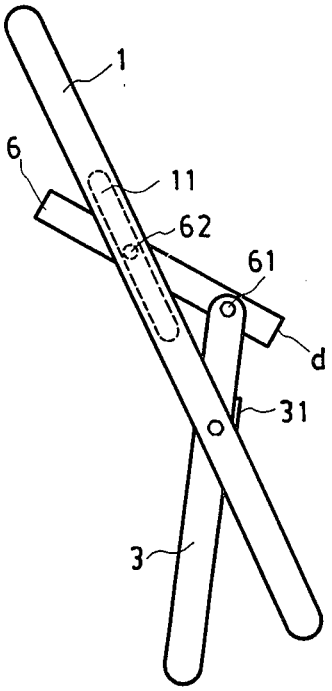
Figure 2D:
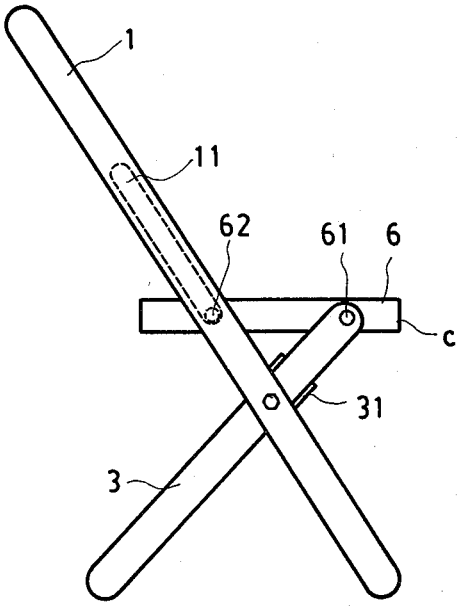

As shown in FIG. 1, the lower section of the two long legs (1) (1') form the front face of the chair while the upper section of legs (1) (1') is used for fixing the chair back (2).

Short legs (3) (3') are connected inside the long legs (1) (1') at each side thereon, both the long legs and the short legs being mounted on an axle rod (4) for pivotal movement thereabout. The lower section of the two short legs (3) (3') form the rear feet of the chair. A cross bar (5) is located between the two rear feet. The upper end of the two short legs are mounted to the left and right foot edge of chair seat (6) by projected bar (61) so as to establish a loose joint to permit pivotal movement between the short legs (3) (3') and chair seat (6). A long sliding groove (11) is defined along the inner side of said two long legs (1) (1') and in which is fitted the projected stud (62) attached to the left and right rear sides of chair seat (6) to permit reciprocal sliding movement of stud (62) in groove (11).

Figure 3:
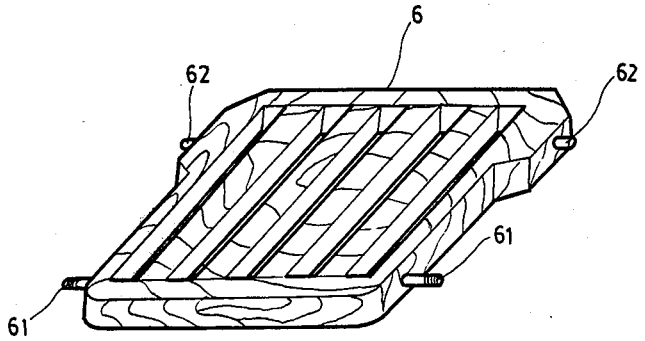
FIG. 3 is a perspective view showing the structure of the chair seat, wherein both seat faces are made of wood.

In the upper section of the short legs (3) (3'), there are provided moveable clamping pieces (31) attached near the axle rod (4). The two faces of the chair seat (6) and chair back (2) may be constructed of different materials in different colors; in other words, if one face of the chair seat and back is constructed of rattan or wood which has a better ventilation quality for summer time use, the other side of the chair seat and back should be made of sponge or foam rubber which has a better warming quality for winter time use. Of course, the chair seat (6) may also be constructed of same material on both faces as shown in FIG. 3.

FIG. 2 shows the gradual steps used when reversing the chair seat and back. The rear feet of the chair are used as the fulcrum in folding or unfolding the chair. When folding the chair, one pulls the rear edge (a) of chair seat (6) upwards to point (b). The front edge (a) of the chair seat can then be pivoted to its reverse direction at point (d) by pushing edge (c) through the separated long legs and by so doing to reverse the seat portions. Thereafter, one continues to pull the front edge (c) from point (d) to point (e). It should be noted that the chair back is simultaneously changed to another face which is of a similar material as the exposed chair seat. When pulling the rear edge of the chair seat (6) upwards, the projected stud (62) slides upwards in the sliding groove (11) on the long legs (1) (1'). When stud (62) is moved almost to the top end of groove (11), the seat reversing process for the chair is completed. Thereafter, by allowing the projected stud 62) to slide downwards to the bottom of groove 11, the chair seat (6) will be flatly disposed ready for use.

For storing purposes, one simply folds the long legs (1) and short legs (3) so that they are parallel, and the clamping piece (31) on the short legs is pivotably moved so as to retain both the long legs (1) and short legs (3) thereby preventing them from being unfolded. Thus, when the chair is not in use, it may be folded by aligning the long legs (1), (1') and the short legs (3), (3') in parallel. By moving the pivotable clamping piece (31) on the short legs (3), (3') at an angle of e.g. 90° as shown in FIG. 1, the long and short legs are retained in the parallel position. Before the long legs and the short legs can be set in a cross position, the pivotable clamping piece (31) is moved out of clamping engagement and aligned with the short legs, i.e., the only function of said moveable clamping piece is to retain the long legs (1), (1') and short legs (3), (3') in a folded position.

Figure 4:
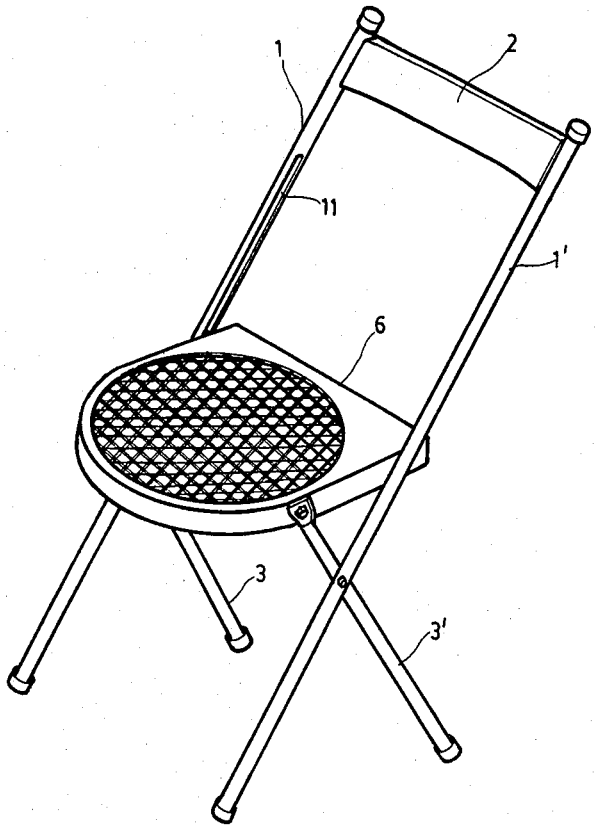
FIG. 4 is another embodiment of this invention wherein the long and short legs are made of metal pipe.

What has been mentioned above is considered to be merely a preferred embodiment, but not as a limitation of this invention. The long legs (1) and short legs (3) in the chair may also be constructed of metal pipe or other material as shown in FIG. 4. Moreover, the chair seat (6) of this invention may not be limited to a square shape but may also be round, semi-oval or other shapes.

Figure 5:
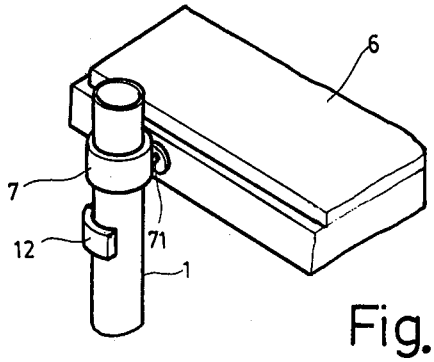
FIG. 5 shows an embodiment of the sleeve ring according to this invention being fitted to the long leg.
Figure 7:
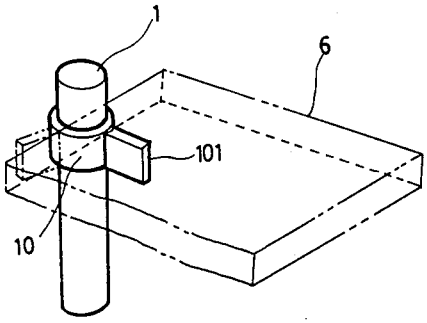
FIG. 7 shows an embodiment of a rotary sleeve ring of this invention fitted to the long leg.

Further, the long legs (1) of the chair may not be furnished with sliding grooves (11) and instead, its functions could be provided by a sleeve ring (7) as shown in FIG. 5, which is particularly well suited for a chair with metal pipe legs. In addition, the sleeve ring (7) may include a projected lug (71) toward one side of the chair seat, which is designed to be inserted into a mortise-like hole on the side of chair seat on a loose joint basis. In order to minimize the friction between projected lug (71) and the mortise-like hole, the hole is preferably fitted with a bush (63).

At a suitable point along the long legs (1), there can be provided a flange (12) which is used for stopping the sleeve ring (7) when it reaches the lowest limit during sliding, e.g., when the chair seat is flatly disposed ready for use.

Figure 6:
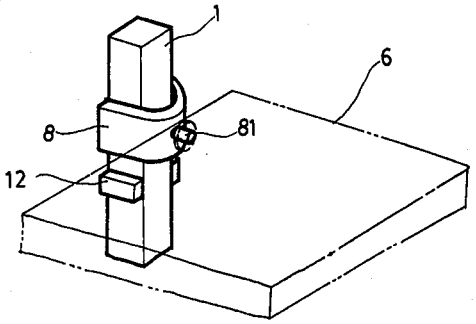
FIG. 6 shows an embodiment of the clamping sleeve of this invention being fitted to the long leg.

Moreover, the aforesaid means may be replaced with a clamping sleeve (8) as shown in FIG. 6, which is preferred for long legs which are round, square, or other multi-angle shapes, etc.

In this invention, when the long leg (1) is a round shape, the sliding groove as a guide way on the long legs (1) for reversing the chair seat does not need to be utilized. Instead, a round channel around a suitable section on the long legs can be furnished so as to fit the rotary sleeve ring (10) in the round channel. On the sleeve ring (10), a supporting lug (101) is furnished for supporting the bottom of the chair seat (6) when the sleeve ring (10) on the long legs (1) is rotated to the right position.

When reversing the chair seat face, the sleeve ring (10) is first rotated so as to turn supporting lug (101) away from said chair seat (6) bottom, and then the chair seat (6) can be turned over. The chair is then ready for use.

Figure 8:
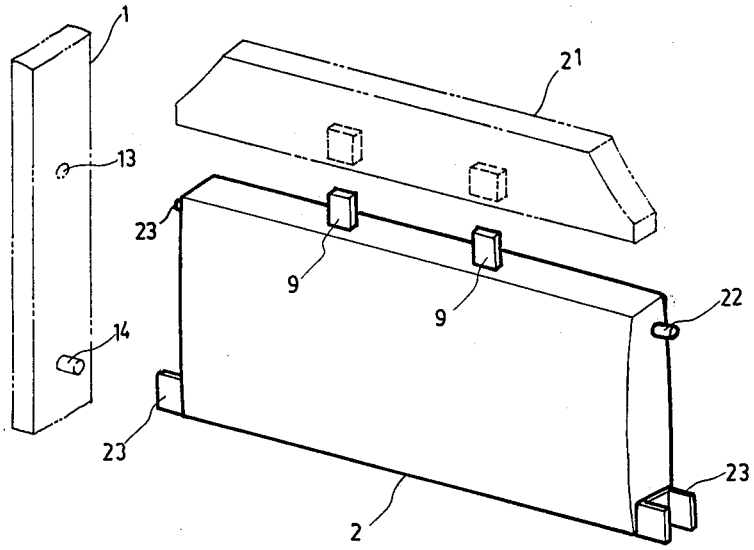
FIG. 8 shows an embodiment of the leaf spring fitted to the chair back of this invention.

The chair back (2) of this invention may be designed in such a way that it is flexible so as to fit the user at a self-adjusted angle. As shown in FIG. 8, the chair back (2) is attached to the cross bar (21) with spring (9). At the upper side section of chair back (2), a stud (22) is furnished. Also, at the lower side of chair back (2), a U-shaped retainer (23) is furnished in operative association with stud (14). At corresponding points on the long legs (1) (1'), a hole (13) is provided for mating with stud (22) and stud (23), respectively. When the user sits upon the chair and against the chair back, back (2) will be urged backwards to a desired angle as a result of spring (9) until the stud (14) is stopped by the U-shaped retainer (23). As soon as the person removes pressure against the chair back (2), it will be restored to its original position automatically as a result of the biasing effect of spring (9).

I claim:

1. A folding chair having a seat which is reversible to expose either a first sitting area or a second sitting area, said chair comprising:

a pair of separated long and short legs, each of said pairs having an upper end portion and a lower surface engaging end portion;

a seat back member connected between and separating said pair of long legs in the vicinity of said upper end portion of said pair of long legs;

pivot means connecting said pair of long legs and said pair of short legs one to another for permitting relative pivotal mevement thereof;

a chair seat having front and rear ends and defining a surface upon which a person can sit when said chair seat is disposed substantially horizontally, said chair seat including a first sitting area on the upper surface and a second sitting area on the lower surface thereof;

connecting means pivotably connecting said front end of said chair seat to said upper end portion of said pair of short legs and slideably pivotably connecting said rear end of said chair seat to said pair of long legs for permitting said chair seat to be moveable between (a) a first unfolded position wherein said chair seat is disposed substantially horizontally exposing said first sitting area as the area upon which a person sits and each of said surface engaging end portions of each of said pairs of short and long legs are spaced apart relative to one another to support the weight of a person sitting upon said first sitting area; (b) a folded position wherein said pairs of short and long legs and said chair seat are substantially aligned one with another; and (c) a second unfolded position wherein said chair seat is disposed substantially horizontally exposing said second sitting area as the area upon which a person sits and each of said surface engaging end portions of each of said pairs of short and long legs are spaced apart relative to one another to support the weight of a person sitting upon said second sitting area; wherein said connection means is for permitting reversal of said first and second areas by allowing movement between said first and second unfolded positions by virtue of the sliding connection of said rear end of said chair seat and said pair of long legs thus permitting said rear end to be simultaneously upwardly slideable and pivotable relative to said pair of long legs while said pivotable connection between said front end of said chair seat and said pair of short legs permit said chair seat and said pair of short legs to be moved into alignment with said pair of long legs in response to said upward sliding movement and, thereafter, downward sliding movement of said rear end of said chair seat responsively effects movement of the front end of said chair seat to expose one or the other of said first and second sitting areas to permit a person to sit thereon as desired.

2. A folding chair as in claim 1 wherein said connecting means includes means defining opposing elongated slots in said pair of long leg members and stud members fixed to the rear end of said chair seat and slideably received in said slots.

3. A folding chair as in claim 1 wherein said connecting means includes sleeve means at least partially surrounding each one of said pair of long legs and pivotably connected to the rear end of said chair seat for permitting sliding and pivotal movement of said chair seat relative said pair of long legs.

4. A folding chair as in claim 3 wherein said long legs are tubular.

5. A folding chair as in claim 4 wherein said tubular long legs define a round cross-sectional shape.

6. A folding chair as in claim 4 wherein said tubular long legs define a square cross-sectional shape.

7. A folding chair as in claim 1 wherein said seat back member includes automatic adjusting means for yieldably displacing at least one portion of said seat back between a normal position and a displaced position in response to pressure being exerted thereon to automatically adjust said at least one portion of said seat back to the person sitting in said chair.

8. A folding chair as in claim 2 wherein said seat back member includes automatic adjusting means for yieldably displacing at least one portion of said seat back between a normal position and a displaced position in response to pressure being exerted thereon to automatically adjust said at least one portion of said seat back to the person sitting in said chair.

9. A folding chair as in claim 3 wherein said seat back member includes automatic adjusting means for yieldably displacing at least one portion of said seat back between a normal position and a displaced position in response to pressure being exerted thereon to automatically adjust said at least one portion of said seat back to the person sitting in said chair.

10. A folding chair as in claim 7 wherein said adjusting means includes engaging means operatively engaging said seat back and said pair of long legs for permitting said at least one portion of said seat back to be pivotably displaced, and biasing means biasing said at least one portion of said seat back in a direction towards said normal position.

11. A folding chair as in claim 10 wherein said engaging means is disposed so as to effect movement of the lower portion of said seat back and wherein said adjusting means further includes limit means disposed in the vicinity of said lower portion to limit movement thereof between said normal and displaced positions.

12. A folding chair as in claim 11 wherein said limit means includes a pair of U-shaped members having forward and rearward legs defining an area in which said seat back is displaceable, the forward leg of said U-shaped member defining said normal position and the rearward leg of said U-shaped member defining said displaced position.

13. A folding chair as in claim 1 wherein said first and second sitting areas are constructed of different materials.

14. A folding chair as in claim 1 further comprising clamping means operatively associated with one of said first or second pairs of leg members for removeably clamping said first and second pairs of leg members one to another when said chair seat and said first and second pairs of leg members are moved into substantial alignment with one another.

15. A folding chair as in claim 14 wherein said clamping means includes at least one pair of clamping members pivotably connected to one of said leg members of one of said first or second pairs of leg members, said pair of clamping member being pivotable between a clamping position wherein the associated one of the leg members of the other of said first or second pairs of leg members is retained in clamped relationship with said one leg member, and an unclamped position wherein pivotal movement of said first and second pairs of leg members relative to one another is permitted.

16. A folding chair having a seat which is reversible to expose either a first sitting area or a second sitting area comprising:

frame means including first and second pairs of leg members pivotably connected to one another at a predetermined pivot point and a chair back connected to one of said first or second pairs of leg members for supporting the weight of a person sitting upon said chair;

a chair seat defining opposing first and second sitting areas on the upper and lower surfaces thereof, respectively; and means connecting said chair seat to said first and second pairs of leg members at a position between said pivot point and said chair back for (a) effecting sliding and pivotal movement of said chair seat relative to said one pair of leg members while yet permitting pivotal movement of said chair seat relative the other pair of leg members, (b) permitting said chair seat to be reversed to expose either one of said first or second sitting areas by allowing said chair seat to be moveable for exposing either one of said upper or lower surfaces and thus either one of said first or second sitting areas, respectively, by virtue of said sliding and pivotal connection to said one pair of leg members and the pivotal connection to said other pair of leg members, and (c) permitting said chair seat and said first and second pairs of leg members to be substantially aligned one to another to facilitate flat storage of said chair.

17. A folding chair as in claim 16 wherein said connecting means includes means defining opposing elongated slots in said first pair of leg members, and stud members fixed to said chair seat and slideably received in said slots.

18. A folding chair as in claim 16 wherein said connecting means includes sleeve means at least partially surrounding each one of said first pair of leg members and pivotably connected to said chair seat for permitting sliding and pivotal movement of said chair seat relative said pair of long legs.

19. A folding chair as in claim 18 wherein said first pair of leg members are tubular.

20. A folding chair as in claim 19 wherein said tubular first pair of leg members define a round cross-sectional shape.

21. A folding chair as in claim 19 wherein said tubular first pair of leg members define a square cross-sectional shape.

22. A folding chair as in claim 16 wherein said seat back member includes automatic adjusting means for yieldably displacing at least one portion of said seat back between a normal position and a displaced position in response to pressure being exerted thereon to automatically adjust said at least one portion of said seat back to the person sitting in said chair.

23. A folding chair as in claim 17 wherein said seat back member includes automatic adjusting means for yieldably displacing at least one portion of said seat back between a normal position and a displaced position in response to pressure being exerted thereon to automatically adjust said at least one portion of said seat back to the person sitting in said chair.

24. A folding chair as in claim 18 wherein said seat back member includes automatic adjusting means for yieldably displacing at least one portion of said seat back between a normal position and a displaced position in response to pressure being exerted thereon to automatically adjust said at least one portion of said seat back to the person sitting in said chair.

25. A folding chair as in claim 22 wherein said adjusting means includes engaging means operatively engaging said seat back and said first pair of leg members for permitting said at least one portion of said seat back to be pivotably displaced, and biasing means biasing said at least one portion of said seat back in a direction towards said normal position.

26. A folding chair as in claim 25 wherein said engaging means is disposed so as to effect movement of the lower portion of said seat back and wherein said adjusting means further includes limit means disposed in the vicinity of said lower portion to limit movement thereof between said normal and displaced positions.

27. A folding chair as in claim 26 wherein said limit means includes a pair of U-shaped members having forward and rearward legs defining an area in which said seat back is displaceable the forward leg of said U-shaped member defining said normal position and the rearward leg of said U-shaped member defining said displaced position.

28. A folding chair as in claim 27 further comprising clamping means operatively associated with one of said first or second pairs of leg members for removeably clamping said first and second pairs of leg members one to another when said chair seat and said first and second pairs of leg members are moved into substantial alignment with one another.

29. A folding chair as in claim 28 wherein said clamping means includes at least one pair of clamping members pivotably connected to one of said leg members of one of said first or second pairs of leg members, said pair of clamping member being pivotable between a clamping position wherein the associated one of the leg members of the other of said first or second pairs of leg members is retained in clamped relationship with said one leg member, and an unclamped position wherein pivotal movement of said first and second pairs of leg members relative to one another is permitted.

30. A folding chair as in claim 16 wherein first and second sitting areas are constructed of different materials.

* * * * *